United States Patent [19]

Hofmann

[11] 4,443,047

[45] Apr. 17, 1984

[54] SPARK PLUG WIRING ASSEMBLY

[75] Inventor: Gloris R. Hofmann, Fond du Lac, Wis.

[73] Assignee: Brunswick Corporation, Skokie, Ill.

[21] Appl. No.: 334,949

[22] Filed: Dec. 28, 1981

[51] Int. Cl.[3] ..... H01R 13/516

[52] U.S. Cl. ..... 339/26; 339/208; 339/210 R

[58] Field of Search ..... 339/26, 210 R, 210 M, 339/75 P, 208

[56] References Cited

U.S. PATENT DOCUMENTS

| | | | |
|---|---|---|---|
| 2,745,075 | 5/1956 | Simpkins et al. | 339/26 |
| 3,344,393 | 9/1967 | Hendee | 339/75 P |
| 3,717,179 | 2/1973 | Clark | 339/210 R |
| 4,143,934 | 3/1979 | Siebert | 339/75 P |
| 4,145,106 | 3/1979 | Livingston | 339/26 |
| 4,169,643 | 10/1979 | Gallagher | 339/75 P |

FOREIGN PATENT DOCUMENTS

| | | | |
|---|---|---|---|
| 2259860 | 6/1973 | Fed. Rep. of Germany | 339/208 |
| 374107 | 6/1932 | United Kingdom | 339/26 |

*Primary Examiner*—John McQuade
*Assistant Examiner*—Gary F. Paumen
*Attorney, Agent, or Firm*—O. T. Sessions

[57] ABSTRACT

The invention provides a wiring assembly (10) for connecting a spark plug (21) to a high voltage source (16). A shell (23) is provided over the flexible boot (20) to prevent damage to the clip (17) on removal and attachment to the spark plug terminal (13). A tie strap (33) is provided around the spark plug lead (11) to prevent the plug connector (14) from being removed from its terminal (15) without disengaging the boot (31).

8 Claims, 6 Drawing Figures

SPARK PLUG WIRING ASSEMBLY

DESCRIPTION

1. Technical Field

This invention relates to high-voltage electrical wiring assemblies and particularly to such assemblies for connecting the spark plug of an internal combustion engine to a high voltage source.

2. Background Art

Spark ignited internal combustion engines generally employ a spark plug for each cylinder to ignite the fuel mixture. The spark plug generally employs a pair of electrodes defining a gap across which a spark is initiated by the application of a high voltage. Typically, the spark plug is connected to a high voltage source by a lead having an inner conductor surrounded by an insulator. A clip, formed of sheet metal, is clamped to the lead by an element having prongs which penetrate the insulation and contact the conductor. The clip includes an end in a partial cylindrical form adapted to be snapped over a spark plug terminal. An L-shaped flexible insulating boot covers the connection of the lead to the spark plug.

A problem arises with such a connection when the lead is removed from the spark plug by pulling on the portion of the lead or boot remote from the spark plug. Removal in such a manner tends to bend and deform the cylindrical portion of the clip, as illustrated in FIG. 2. When the clip is subsequently reattached to the spark plug, a poor connection is made because of the enlarged form of the clip.

DISCLOSURE OF INVENTION

In accordance with the present invention an ignition connection means for connecting a spark plug to a high voltage source includes an ignition lead having an outer insulating cover, a connecting clip attached to the ignition lead for connection to a spark plug terminal extending generally perpendicular to the ignition lead, and a flexible, L-shaped insulating boot covering the connecting clip and the spark terminal. A shell means is provided to cover the insulating boot to limit bending of the boot while the clip is attached or removed from the spark plug terminal, thereby preventing damage to the clip.

The shell means may conveniently include a projection extending generally parallel to and in the opposite direction from the ignition lead to facilitate removal of the connection from the spark plug terminal.

The shell means can be formed from two similar L-shaped segments and include attachment means for attaching the segments together over the flexible boot. Preferably, the two shell segments are hinged together by a hinge formed integrally with the two segments and including latch means for holding the two segments together. The latch means can include a slot in one of the segments and a locking tab on the other, with the locking tab extending through the slot to hold the two segments together. In the preferred embodiment the shell means is formed of molded plastic.

BEST MODE FOR CARRYING OUT THE INVENTION

Figure 1:
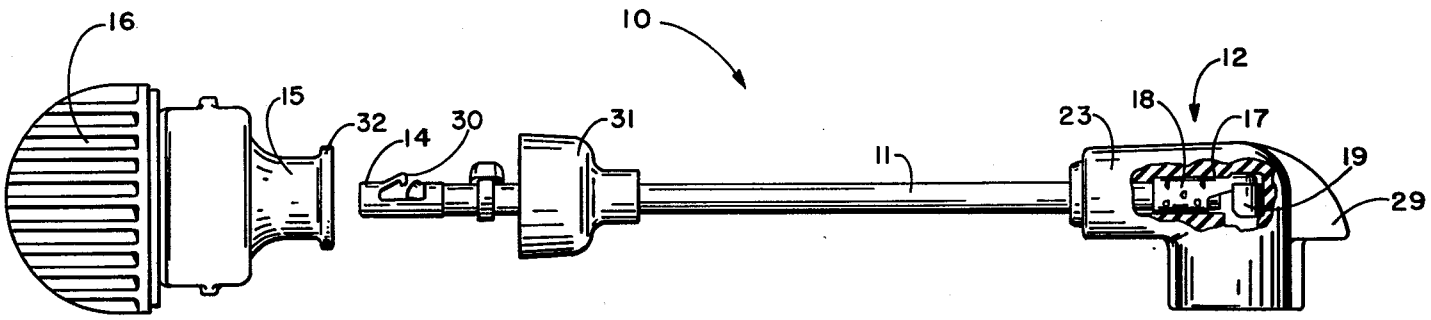
FIG. 1 is a view of an ignition connector according to the invention, partially broken away to show the connecting clip.

Referring to the drawings, a connector 10 according to the invention is shown. The connector 10 includes an insulated lead 11 terminated at the spark plug end by a connecting cap 12 adapted to be snapped over the spark plug terminal 13. The other end of the lead 11 is terminated by a plug connector 14 adapted to engage a cup in the high voltage secondary tower 15 of an ignition transformer 16.

Figure 4:
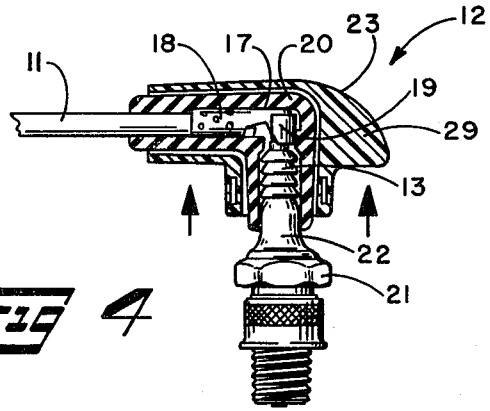
FIG. 4 is a view of the connector in section.

As most clearly shown in FIG. 4, a clip 17 formed of sheet metal includes a clamping segment 18 encircling the lead 11 and has prongs which penetrate the lead's insulation to contact the inner conductor, not shown. The end of the clip 17 has a partial cylindrical form 19 for snapping over the spark plug terminal 13. A flexible, L-shaped boot 20, preferably formed of a flexible elastomer, covers the L-shaped connection of the spark plug 21 to the lead 11. The boot 20 extends over the lead 11 and spark plug insulator 22 for a sufficient distance to insulate the connecting clip 17.

Figure 3:
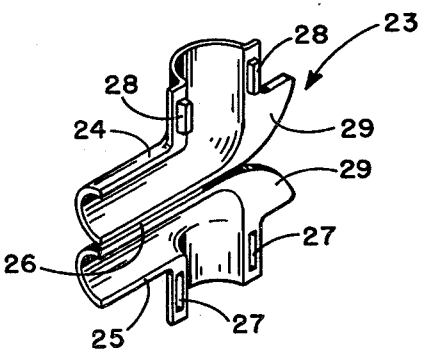
FIG. 3 is a view of the shell of the invention prior to assembly.
Figure 5:
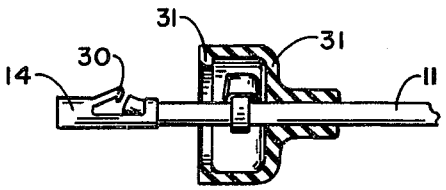
FIG. 5 is a partial sectional view of the end of the connector remote from the spark plug.
Figure 6:
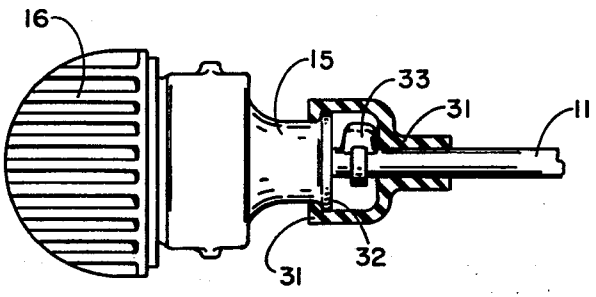
FIG. 6 is a partial sectional view showing the remote end of the connector as installed.

In accordance with the invention, a stiffening shell 23 is provided over the L-shaped boot 20 to prevent excessive bending of the connecting clip 17 during attachment and removal. The shell 23, shown in FIG. 3 in its form prior to assembly, includes two segments 24 and 25 shaped to closely fit the external shape of the boot 20 when the boot 20 is in position over the spark plug terminal 13. The shell 23 is formed of polypropylene and may conveniently be manufactured by injection molding.

The two segments of the shell 23 have walls sufficiently thick to provide the desired stiffness and are connected by a strip 26 extending between the two segments. The connecting strip is sufficiently thin to allow the strip 26 to function as a hinge.

One of the segments 25 includes two slots 27, one on each side of the leg of the segment remote from the hinge element 26. The other segment 24 includes two locking tabs 28 located in positions corresponding to the two slots 27. The locking tabs 28 have enlarged ends suited for spreading the walls of the slots 27 as they are forced through the slots 27. When the enlarged ends have passed through the slots 27, the walls close behind the enlarged ends to positively lock the two segments 24 and 25 together. The shell 23 can thus be folded along the hinge 26 over the boot 20 and locked in place.

To allow the connection to be conveniently removed from the spark plug 21 a projection 29 is provided on the ends of the shell segments 24 and 25 extending generally parallel to and in the opposite direction from the ignition lead. Thus force can be applied to the connector in a direction parallel to the spark plug terminal 21 as shown by the arrows in FIG. 4, to remove the connector from the spark plug 21.

Figure 2:
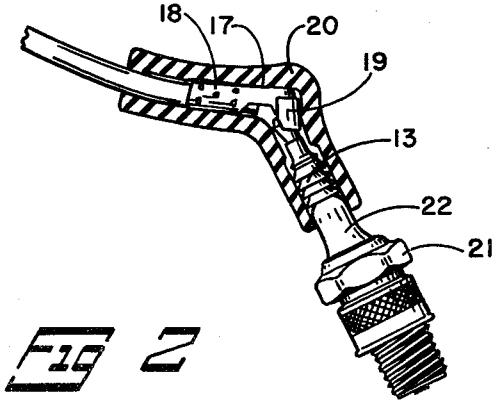
FIG 2 PRIOR ART
FIG. 2 is a partial sectional view of a prior art connector.

The connector can be readily removed by grasping the shell 23 and pulling it away from the spark plug 21, yet cannot be removed by pulling on the lead 11. Thus the clip 17 cannot be damaged by excessive spreading during removal as can the prior connector shown in FIG. 2. Further, the connection is protected from inadvertent removal, thus providing a connection which is highly safe and dependable, particularly if used in environments where arcing caused by a loose connection could create a hazard.

To further assure electrical connection between the ignition transformer 16 and the spark plug 21, the connection to the ignition transformer tower 15 uses a plug connector 14 to connect with a cup shaped terminal in the tower 15. The plug connector 14 is clamped to the spark plug lead 11 and includes a projecting tab 30 to positively engage the tower terminal 15. A boot 31 is provided over the plug 14 and includes a circumferential internal ridge 31 to engage a lip 32 around the end of the tower 15. To prevent the lead 11 from being pulled through the boot 31 an annular projection 33 is provided around the lead 11. The projection 33 is conveniently provided by a conventional cable tie strap, such as Part No. PLT1M-MP0, available from Panduit Corporation, tightly encircling the lead 11. Thus the spark plug lead cannot be removed from the tower 15 without disengaging the boot 31.

I claim:

1. An ignition connection means for connecting a spark plug to a high voltage source comprising:

(A) an ignition lead having an outer insulating cover;

(B) a connecting clip means attached to said ignition lead for connection to a spark plug terminal extending generally perpendicular to said ignition lead;

(C) a flexible, L-shaped insulating boot covering said connecting clip means and for covering said spark plug terminal; and (D) a shell means covering only said insulation boot for limiting bending of said boot while said clip means is being attached or removed from said spark plug terminal to prevent damage to said clip means.

2. The ignition connection means defined in claim 1 wherein said shell means includes a projection extending generally perpendicular to said spark plug terminal to facilitate removal of said connection means from said spark plug terminal.

3. The ignition connection means defined in claim 2 wherein said shell means is formed from two similar L-shaped segments and includes attachment means for attaching said two segments together over said flexible boot.

4. The ignition connection means defined in claim 3 wherein said attachment means includes a hinge connecting said two segments.

5. The ignition connection means defined in claim 4 wherein said attachment means further comprises a latch means remote from said hinge for holding said two segments together over said flexible boot.

6. The ignition connection means defined in claim 5 wherein said hinge is formed integrally with said two segments.

7. The ignition connection means defined in claim 6 wherein said latch means includes a slot in one of said segments and a locking tab on the other of said segments, said locking tab projecting through said slot and holding said two segments together over said boot.

8. The ignition connection means defined in claim 7 wherein said shell means is formed of molded plastic.

* * * * *